US005628684A

United States Patent [19]

Bouedec

[11] Patent Number: 5,628,684

[45] Date of Patent: May 13, 1997

[54] GAME SYSTEM INCLUDING AN INSTANT WIN GAME AND A SECOND GAME INITIALIZED BY A WINNING INSTANT WIN GAME TICKET

[75] Inventor: Jean-Etienne Bouedec, Charenton, France

[73] Assignee: La Francaise des Jeux, Neuilly-sur-Seine, France

[21] Appl. No.: 375,808

[22] Filed: Jan. 19, 1995

[30] Foreign Application Priority Data

Jan. 28, 1994 [FR] France ..... 94 00945

[51] Int. Cl.[6] ..... A63F 3/06; A63F 9/22

[52] U.S. Cl. ..... 463/17; 463/40; 463/22; 273/138.2; 273/139

[58] Field of Search ..... 273/138 A, 139, 273/138.2; 463/17, 22, 40

[56] References Cited

U.S. PATENT DOCUMENTS

| | | | |
|---|---|---|---|
| 4,677,553 | 6/1987 | Roberts et al. | 273/138 A |
| 4,842,278 | 6/1989 | Markowicz | 273/138 A |
| 5,007,641 | 4/1991 | Seidman | 273/138 A |
| 5,088,737 | 2/1992 | Frank et al. | 273/138 A |
| 5,290,033 | 3/1994 | Bittner et al. | 273/138 A |
| 5,472,196 | 12/1995 | Rusnak | 273/138 R |

FOREIGN PATENT DOCUMENTS

| | | | |
|---|---|---|---|
| 72923 | 3/1983 | European Pat. Off. . | |
| 356414 | 2/1990 | European Pat. Off. . | |
| 450520 | 10/1991 | European Pat. Off. . | |
| 2148135 | 5/1985 | United Kingdom | 273/138 A |
| WO91/04082 | 4/1991 | WIPO . | |
| WO93/05483 | 3/1993 | WIPO . | |

*Primary Examiner*—Benjamin H. Layno
*Attorney, Agent, or Firm*—Bell, Seltzer, Park & Gibson

[57] ABSTRACT

A game system comprises an instant win first game based on the purchase of a game ticket which is a win ticket or a lose ticket, and at least one game console which is initialized by a win ticket to participate in at least one second game, for example a video game, displayed on the game console and executed under the control of a remote computer at a central site.

18 Claims, 1 Drawing Sheet

GAME SYSTEM INCLUDING AN INSTANT WIN GAME AND A SECOND GAME INITIALIZED BY A WINNING INSTANT WIN GAME TICKET

The invention concerns a game system intended to be installed in a public place and under the control of a properly approved company.

BACKGROUND OF THE INVENTION

A distinction can be drawn between "on line" games and "off line" games.

An "on line" game relies on computer processing of data collected from players via game terminals which dispense game receipts.

These terminals are connected by a transmission network to a computer at a central site where independent apparatus, such as a sphere containing numbered balls, performs a draw whose result is transmitted by the computer to the various terminals for checking the win game receipts before issuing the winnings in application of a prepublished table of winnings.

An "off line" game involves selling lottery tickets with the draw taking place later in the case of the traditional national lottery or on the spot in the case of an instant win computer lottery. In this type of game there are no game terminals and no transmission network connected to a central computer.

OBJECTS AND SUMMARY OF THE INVENTION

The main object of the invention is to provide a game system based on the games mentioned above and which is more attractive because it gives players direct access to a game in which they can participate in accordance with predetermined rules.

To this end the invention proposes a game system comprising an instant win first game based on the purchase of a game medium which carries a win or lose result and at least one game console initialized by a win game medium from the first game to participate in at least one second game, for example a video game, displayed on the game console.

According to another feature of the game system of the invention the game console is connected to a computer at a central site by a transmission network, this site being equipped with apparatus for live execution of at least one second game and means for transmitting to the video game console the progress and the result of the second game, and the game console is equipped with a display unit to enable players to follow the progress and find out the result of the second game executed at the central site, game data capture means for transmitting game data to the computer at the central site before and/or during the second game and a printer unit for printing out a win receipt under the control of the computer at the end of the second game.

For example, the second game is the result of a draw effected by apparatus comprising a sphere containing numbered balls and the means for transmitting the progress and the result of the second game include a video camera looking at the apparatus and connected to the computer.

Alternatively, the second game can be the result of computer processing corresponding to the execution of game software prerecorded in a memory of the computer at the central site, the computer synthesizing images which are transmitted to the game console to enable players to follow the progress of the second game live and to find out the result.

The second games that can be offered to players can be games of chance, skill and/or strategy, such as: the letters and numbers quiz or chess, etc.

In accordance with another feature of the game system of the invention, the win receipt printed out by the printing device of the game console includes printed information concerning the amount of the winnings and identification information prerecorded in the memory of the computer at the central site for checking the validity of the win receipt.

The identification information on the win receipt can be coded in a bar code that can be read magnetically or optically.

In accordance with another feature of the invention, the game system also includes at least one game terminal connected to the computer at the central site and including at least one reader device for reading the identification information on a win receipt and transmitting it to the computer at the central site for checking that the identification information received matches that prerecorded in its memory before transmission to the terminal of a signal authorizing payment of the winnings printed on the win receipt.

As a general rule the game consoles and the game terminals are installed on the premises of approved retailers who also sell game media for the instant win first game. These media can be either tickets or electronic chip cards, tokens, or keys, for example.

In a first planned game system, the game medium is a ticket purchased from a retailer and which includes game data in the form of at least one printed sign showing, after scratching, whether the ticket is a win ticket or a lose ticket and identification information prerecorded in the memory of the computer at the central site for checking the validity of a win ticket.

The identification information on a ticket of the instant win first game is coded in a bar code that can be read magnetically or optically.

Usually, a game console also includes a reader device for reading the identification information on a ticket of the instant win first game to transmit it to the computer at the central site which verifies the agreement of the information with that prerecorded in its memory when the ticket is printed before validating access to the game console.

In a second planned game system, the game medium of the first game is an electronic chip card, token, or key, for example, which is also purchased from a retailer and in which several instant win games are prerecorded, with win or lose data that can be read by the game console which automatically carries out an operation that is an analog of scratching to determine whether this data indicates a win or a lose.

The reader device in the game console reads the identification information and the game data of at least one first game prerecorded in a medium such as a card, this information and data being transmitted to the computer at the central site for checking the card and determining whether the game data indicates a win or a lose, the result being displayed on the display unit of the game console to tell the player the result and whether he is entitled to participate in the second game.

As a general rule the game terminal can be integrated into the game console.

A major advantage of the invention is that the game console is not coin or token operated and does not pay out in cash or in tokens at the end of the second game and is therefore not a target for acts of vandalism aimed at stealing any money or win tokens held in the game console.

Another advantage of the invention is that the game system is totally secure because the win result of the first game is checked by the central site computer to provide access to the second game, and the win receipt printed out at the end of the second game is also checked by the central site computer to authorize payment of the amount printed on the win receipt.

In general, it should be observed that operation of the game console is not dependent on chance, given that the win result at the end of the second game is determined at the central site.

As a result, the game system is not prejudicial to public order. This is a further advantage of the invention.

In both of the above-outlined game systems, the game console is merely a dumb terminal for data capture, displaying a second game executed at the central site, communicating the result of the second game and printing out a win receipt on the instructions of the central site computer.

A further advantage of the invention is that the game console can also be used to broadcast information and so generate some public interest at the installation site.

The second games offered by the central site and displayed by the game console can be such that they are perceived as increasing the winnings, if any, from the first game, preferably in such a way that players can choose how much they can win and therefore how much to risk.

BRIEF DESCRIPTION OF THE DRAWINGS

Other advantages, features and details of the invention emerge from the following explanatory description given by way of example only, and with reference to the accompanying drawings in which.

MORE DETAILED DESCRIPTION

Figure 1:
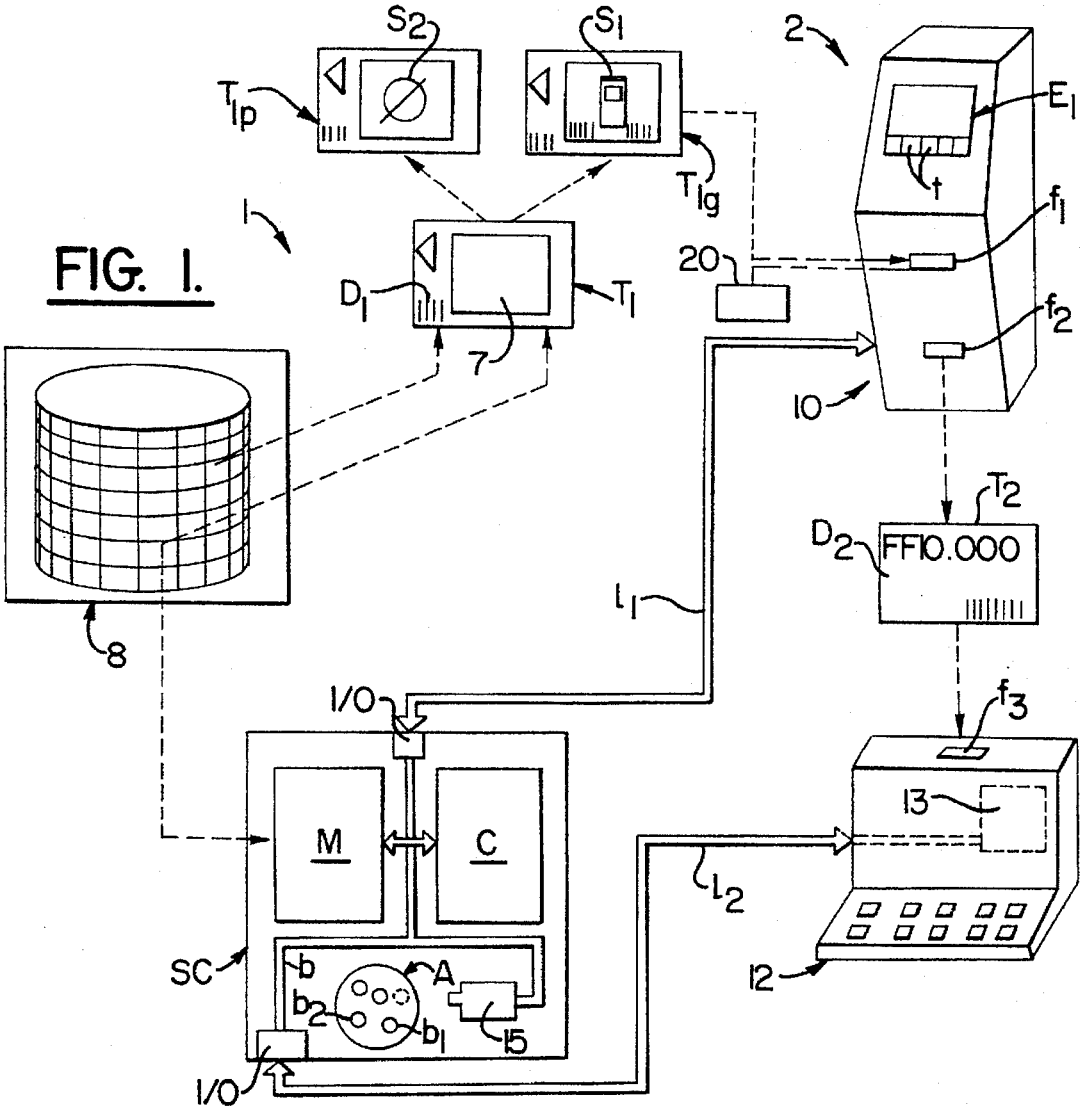
FIG. 1 is a diagram showing the structure and the operating principle of a game system in accordance with the invention.

FIG. 1 is a diagram showing the structure of a first embodiment of game system in accordance with the invention. This game system includes an instant win type first game combined with a second game, a video type game, for example, access to which is dependent on the result of the first game.

For example, the first game 1 is based on the purchase of a game medium such as a printed ticket $T_1$ which represents a win or a lose. Each printed ticket $T_1$ carries identification information $D_1$ and predefined game data determining whether the ticket $T_1$ is a win ticket or a lose ticket.

The identification information $D_1$ is in the form of a bar code, for example, comprising a sequence of alternating black and white stripes with varying width and spacing encoding data for checking that the ticket is valid, for checking its source and for determining whether it is a win ticket or a lose ticket. All this information is prerecorded in a memory M of a computer C at a central site SC where it is protected and under the control of the management company running the game system.

The game data on the ticket $T_1$ comprises signs or symbols, for example, which include at least one win sign $S_1$ or one lose sign $S_2$ which, once it has been printed in the central part of the ticket $T_1$, is covered by a thin scratch-off film 7 in a manner that is known in itself.

All tickets $T_1$ are printed at a printing centre 8 approved by the game system management company and then sold in distribution centres or retail outlets open to the public and also approved by the management company.

The second game 2 is a video game, for example, accessible from a game console 10 connected to the computer C at the central site SC by a transmission network shown here as an electrical link $l_1$ with an input/output interface I/O at each end.

The game system further includes at least one game terminal 12 installed at each retail outlet and connected to the computer C at the central site SC by an electrical link $l_2$ with an input/output interface I/O at each end. Each distribution centre has one game terminal 12 and several game consoles 10, for example.

Figure 2:
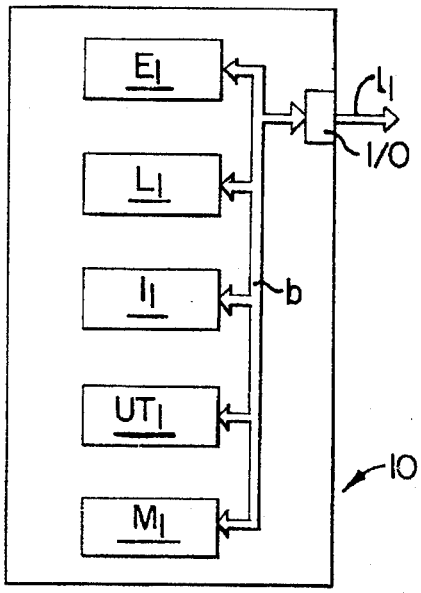
FIG. 2 is a block diagram of the circuits and units constituting the game console of one embodiment of game system in accordance with the invention.

In the example shown in FIG. 2, the game console 10 includes:

- a display unit $E_1$ equipped with a video screen,
- a reader device $L_1$, for example an optical reader, for reading the identification information $D_1$ printed on a ticket $T_1$ after the first game 1,
- a printer device $I_1$ for printing out a game receipt $T_2$ after the second game 2 under the control of the computer C at the central site SC, and
- a processor unit $UT_1$ associated with working memory $M_1$ for transmission of information between the computer C and the game console 10.

All these circuits of the game console 10 are interconnected by a control, data and address bus b.

Referring again to FIG. 1, the game console 10 further includes a first slot $f_1$ for inserting a ticket $T_1$ from the instant win first game 1 and a second slot $f_2$ for dispensing a game receipt $T_2$ at the end of the second game 2. The game receipt $T_2$ printed out by the printer device $I_1$ of the game console 10 subject to conditions explained in detail below includes identification information $D_2$ and details of monetary or other winnings, for example FF 10 000 (ten thousand French francs). As for the ticket $T_1$ from the first game 1, the identification information $D_2$ is coded in a bar code to be read optically, for example.

The game terminal 12 includes a reader 13, for example an optical reader, for reading identification information $D_2$ from a win receipt $T_2$ inserted in a slot $f_3$ of the terminal 12. The information $D_2$ is then sent over the link $l_2$ to the computer C for checking the win receipt $T_2$ before authorizing payment of the amount printed on the receipt. The second game 2 is executed at the central site SC.

In a first embodiment of the game system the second game is a lottery drawn by apparatus A, such as a sphere containing numbered balls $b_1, b_2, \ldots, b_n$. This apparatus is not physically connected to the computer C. However, to enable players to follow the draw and find out the result, a video camera 15 is connected to the computer C for live transmission to the game console 10 of pictures of the apparatus A which executes the second game.

The operating principle of the game system described above is as follows.

A player purchases from a retailer a ticket $T_1$ for the instant win first game 1. The player scratches off the film 7 to expose either a win sign $S_1$ or a lose sign $S_2$. Thus the player has either a win ticket $T_{1g}$ or a lose ticket $T_{1p}$.

The player holding a win ticket $T_{1g}$ after the first game 1 can use the ticket to access a second game 2 available at the game console 10. To this end the player inserts the win ticket $T_{1g}$ into the slot $f_1$ of the game console 10. The optical reader $L_1$ reads the identification information $D_1$ written on the ticket $T_{1g}$ and transmits it to the computer C at the central site SC to check that it is a valid ticket, to check its source and to check that it is a win ticket. The computer C then authorizes access to the game console 10, if appropriate.

Once access to the game console 10 has been authorized the computer C offers at least one second game which is displayed on the display unit $E_1$ of the game console 10, which shows touch-screen keys t for the player to use to send game data to the computer C.

If the second game is a draw which is drawn by the apparatus A, the player sends to the computer C his game data which is stored in the memory M. An authorized person at the central site SC then starts the second game which the player can follow live on the video screen of the display unit $E_1$ of the game console 10. When the apparatus A has made the draw an authorized person enters the result of the draw into the computer C which compares it with the player's game data. If they match, the computer C determines the winnings and commands the printing out of a win receipt $T_2$ by the print unit $I_1$ of the game console 10.

The player collects the win receipt $T_2$ dispensed from the slot $f_2$ of the game console 10, knowing that he must go to a game terminal 12 before he can collect the winnings printed on the win receipt $T_2$. Payment of the winnings is conditional on checking of the identification information $D_2$ printed on the win receipt $T_2$. To do this the authorized person operating the terminal 12 inserts the win receipt $T_2$ into the slot $f_3$ of the terminal 12 and the optical reader $l_3$ reads the identification information $D_2$ on the receipt $T_2$ and transmits it to the computer C which responds by authorizing payment, if appropriate.

In a second example the second game is a computer game in the form of software stored in the memory M and run on the computer C at the central site SC. In this case the memory M of the computer can store several types of second game, one of which is selected by the player.

Depending on the type of game 2 selected by the player, the computer can invite the latter, before or while running the game, to enter game data representing a choice, the nature of this choice obviously depending on the type of game. The game data is transmitted to the computer C from touch-screen keys t provided for the use of the player on the display unit $E_1$ of the game console 10.

At the same time the computer C at the central site SC selects or calculates a result and the amount of the winnings. The result and the winnings depend on the choices made by the player on sending game data to the computer C. At the end of the game the computer C compares the result corresponding to the player's choice and the calculated result and commands the printer unit $I_1$ of the game console 10 to print out a win receipt $T_2$ if the two results match. The player could of course make a number of successive choices while playing the second game.

For example, the second game 2 offered to the player could be a game of skill involving the video screen of the display unit $E_1$ of the game console 10 showing a basketball player moving between the two baskets. As the basketball player approaches one of the baskets the chance of scoring increases but the potential winnings are reduced. In this case the game player can choose how much to risk and how much he could win by deciding when to have the basketball player shoot at the basket.

In this example the computer C at the central site SC calculates a time sequence of windows relating to the movement of the basketball player. For each window, the computer C determines if the shot will succeed or not. If the shot does succeed, then the computer makes that window a win window. Accordingly, the result of the second game is decided by which window the game player chooses.

To take another example, the second game 2 offered to the player could be a game of chance in which the display unit $E_1$ shows a series of eight playing cards: four cards that can be seen of each suit and four cards that cannot be seen, associated with the cards that can be seen. For each suit the player must decide if the hidden card is higher, lower or equal in value to the visible card. The player decides which cards to "turn over", and can increase winnings by a "DOUBLE OR QUITS" move, for example.

At the end of the game the player gets a win receipt $T_2$ dispensed from the slot $f_2$ of the game console 10, knowing that he must go to a game terminal 12 to claim the amount of the winnings printed on his win receipt $T_2$. Payment of the winnings is conditional on the computer C checking the identification information $D_2$ printed on the win receipt $T_2$.

Alternatively, the game medium in the form of printed tickets $T_1$ can be replaced with electronic chip cards, tokens, or keys with a memory in which several instant win first games are prerecorded. As previously, each first game includes identification information $D_1$ and win or lose game data $S_1$ or $S_2$.

In this case players purchase a game medium such as a card 20 from a retailer and then insert the card into the slot $f_1$ of the game console 10 where it is read by the reader device $L_1$ and the win or lose outcome of at least one prerecorded first game is displayed on the video screen of the display unit $E_1$ of the game console 10 before the player is authorized to take part in the second game which is played in the manner already described.

In both the above examples the game console 10 and the game terminal 12 are regarded as two separate units installed in retail outlets, but they can be combined in a single unit without changing the principle of the game system.

The game system operates subject to predetermined rules whereby, for example:

- the win receipt $T_2$ always indicates a win regardless of the result of the second game, access to the game console providing a way of increasing the winnings, for example,
- the player can play a second game several times before a win receipt is printed out,
- the ticket $T_1$ from the first game can also represent a win, the winnings being indicated on the ticket instead of the win or lose sign, without this ticket providing access to the game console.

Each game console 10 can also be used to broadcast any kind of information to generate public interest in the retail outlet where it is installed, this information originating from the computer at the central site.

I claim:

1. A game system comprising an instant win first game based on the purchase of a game medium which carries a result which is a win or a lose and at least one game console initialized by a win game medium from the first game to participate in at least one second game different from said first game and displayed on the game console.

2. A game system according to claim 1, wherein said second game is a video game displayed on said game console.

3. A game system according to claim 1, wherein the game console is connected to a computer at a central site by a transmission network.

4. A game system according to claim 3, wherein the central site is equipped with an apparatus for live execution of at least one second game and means for transmitting to the game console the progress and the result of the second game.

5. A game system according to claim 4, wherein said console is equipped with a display unit to enable players to follow and find out the result of the second game executed at the central site.

6. A game system according to claim 4, wherein said console is equipped with game data capture means for transmitting game data to the computer at the central site before and/or during the second game.

7. A game system according to claim 4, wherein said console is equipped with a printer unit for printing out a win receipt under the control of the computer at the end of the second game.

8. A game system comprising an instant win first game based on the purchase of a game medium which carries a result which is a win or a lose and at least one game console initialized by a win game medium from the first game to participate in at least one second game different from said first game and displayed on the game console, wherein the game console is connected to a computer at a central site by a transmission network, wherein the central site is equipped with apparatus for live execution of at least one second game and means for transmitting to the game console the progress and the result of the second game, and wherein said console is equipped with a display unit to enable players to follow and find out the result of the second game executed at the central site, game data capture means for transmitting game data to the computer at the central site before and/or during the second game and a printer unit for printing out a win receipt under the control of the computer at the end of the second game.

9. A game system according to claim 8, wherein the second game is the result of a draw effected by apparatus comprising a sphere containing numbered balls and wherein the means for transmitting the progress and the result of the second game to the video console include a video camera looking at the apparatus and connected to the computer at the central site.

10. A game system according to claim 8, wherein the second game is the result of computer processing corresponding to the execution of game software prerecorded in a memory of the computer at the central site and wherein the computer synthesizes images which are transmitted to the game console to enable players to follow the progress of the second game live and to find out the result.

11. A game system according to claim 8, wherein the win receipt printed out by the printer device of the game console includes printed information concerning the amount of the winnings and identification information prerecorded in the memory of the computer.

12. A game system according to claim 11, wherein the identification information on the win receipt is coded in a bar code that can be read magnetically or optically.

13. A game system according to claim 8, also including at least one terminal connected to the computer at the central site and including at least one reader device for reading the identification information on a win receipt and transmitting it to the computer at the central site for checking the validity of the information before transmission to the terminal of a signal authorizing payment of the winnings printed on the win receipt.

14. A game system according to claim 13, wherein the game console and the terminal are integrated in a single unit.

15. A game system according to claim 8, wherein the game medium is a ticket which includes game data in the form of at least one printed sign showing whether the ticket is a win ticket or a lose ticket and identification information prerecorded in the memory of the computer at the central site for checking the validity of a win ticket.

16. A game system according to claim 15, wherein the identification information on a ticket is coded in a bar code that can be read magnetically or optically.

17. A game system according to claim 15, wherein the game console also includes a reader device for reading the identification information on a ticket or a card and transmitting it to the computer at the central site, said computer verifying the agreement of the identification information with that prerecorded in its memory when the game medium is printed to validate or not access to the game console.

18. A game system according to claim 8, wherein the game medium is an electronic chip card, token or key in which are prerecorded win or lose game data and identification information required for checking the validity of the card.

* * * * *